US012194360B2

(12) United States Patent
Lay

(10) Patent No.: US 12,194,360 B2
(45) Date of Patent: Jan. 14, 2025

(54) STABLE PIVOTAL TILT ADJUSTMENT FOR A PROJECTILE EXPELLING APPARATUS WITH A ROTATING LAUNCH TUBE

(71) Applicant: William Coleman Lay, St. George, UT (US)

(72) Inventor: William Coleman Lay, St. George, UT (US)

( * ) Notice: Subject to any disclaimer, the term of this patent is extended or adjusted under 35 U.S.C. 154(b) by 72 days.

(21) Appl. No.: 18/107,988

(22) Filed: Feb. 9, 2023

(65) Prior Publication Data

US 2024/0269529 A1 Aug. 15, 2024

(51) Int. Cl.
*A63B 69/40* (2006.01)

(52) U.S. Cl.
CPC ..... *A63B 69/406* (2013.01); *A63B 69/40* (2013.01); *A63B 2069/402* (2013.01); *A63B 2225/09* (2013.01)

(58) Field of Classification Search
CPC ... A63B 69/40; A63B 69/406; A63B 69/0002; A63B 69/0004; A63B 69/0006; A63B 69/0008; A63B 2225/09; A63B 65/12; A63B 2069/401; A63B 2069/402; A63B 2069/403; A63B 2069/405; F41B 3/04
USPC ..... 124/4, 6, 78
See application file for complete search history.

(56) References Cited

U.S. PATENT DOCUMENTS 3,794,011 A 2/1974 Newgarden, Jr.
3,981,491 A * 9/1976 Snyder ..... B25H 1/0007 211/22
4,325,351 A 4/1982 Yuasa
4,423,717 A * 1/1984 Kahelin ..... A63B 69/406 124/78
4,632,088 A 12/1986 Bruce
5,832,909 A * 11/1998 Grant ..... A63B 69/406 124/6
5,996,814 A * 12/1999 Workman ..... B62H 3/00 211/22
6,190,271 B1 * 2/2001 Rappaport ..... A63B 69/0002 124/78
6,305,366 B1 * 10/2001 Rizzo ..... A63B 69/406 124/6
6,672,297 B1 * 1/2004 Liao ..... A63B 69/406 124/78
6,732,724 B1 5/2004 Paulson et al.
6,739,325 B1 5/2004 Paulson
(Continued)

*Primary Examiner* — John E Simms, Jr.
(74) *Attorney, Agent, or Firm* — Craig J. Madson; MADSON IP, P.C.

(57) ABSTRACT

An enhanced projectile expelling apparatus provides stability and versatility expelling projectiles at various speeds and trajectories. The projectile expelling apparatus has a rotational expelling housing supported by a supporting stand that is adjustable into innumerable configurations by rotating a launch tube and/or tilting a feeder elbow disposed to abut the launch tube in rotational engagement. A rotational connector assembly facilitated the rotation of the launch tube and a rearwardly-disposed pivot adjustment assembly facilitates the tilting of the feeder elbow. A speed-controlled motor rotates a drive wheel that imparts speed and spin to the projectiles. Depending upon the rotation of the launch tube, tilt of the feeder tube, and rotational speed of the drive wheel, the projectile expelling apparatus expels projectiles in various straight, curving, rising, dropping, and sliding trajectories.

16 Claims, 12 Drawing Sheets

(56) References Cited

U.S. PATENT DOCUMENTS

| | | | | |
|---|---|---|---|---|
| 6,807,959 | B1 | 10/2004 | Murdock et al. | |
| 6,863,059 | B1 | 3/2005 | Lee | |
| 6,983,741 | B2 | 1/2006 | Donald | |
| 7,958,876 | B2 | 6/2011 | Lay | |
| 8,833,355 | B2 | 9/2014 | Paulson | |
| 8,932,156 | B2 | 1/2015 | Boehner | |
| 9,050,520 | B2 | 6/2015 | Lu | |
| 9,579,554 | B1 * | 2/2017 | Madden | A63B 69/408 |
| 2005/0252498 | A1 * | 11/2005 | Donald | A63B 69/406 124/6 |
| 2007/0295318 | A1 * | 12/2007 | Lu | A63B 69/406 124/6 |
| 2009/0095273 | A1 * | 4/2009 | Paulson | A63B 69/0002 124/78 |
| 2009/0260612 | A1 * | 10/2009 | Grant | A63B 69/406 124/78 |
| 2009/0301452 | A1 * | 12/2009 | Lay | A63B 69/406 29/428 |
| 2009/0301453 | A1 * | 12/2009 | Lay | F41B 3/04 124/4 |
| 2013/0087131 | A1 | 4/2013 | Paulson et al. | |
| 2014/0261362 | A1 * | 9/2014 | Boehner | A63B 69/406 124/78 |
| 2022/0266115 | A1 * | 8/2022 | Valenches | A63B 69/406 |

* cited by examiner

STABLE PIVOTAL TILT ADJUSTMENT FOR A PROJECTILE EXPELLING APPARATUS WITH A ROTATING LAUNCH TUBE

BACKGROUND OF THE INVENTION

1. Field of the Invention

The present invention relates to projectile expelling apparatuses, and more particularly, to a projectile expelling apparatus having pivotal tilt adjustment and a rotational expelling housing for launching projectiles at various trajectories.

2. The Relevant Technology

In many sporting events players participate by pitching, hitting, catching, kicking, and/or shooting a moving object. Many players purchase projectile expelling apparatuses to become better players. Some players use projectile expelling apparatuses for pitching baseballs, softballs, tennis balls, footballs, volleyballs, basketballs, and many other types of moving projectiles. In addition, hunters use skeet throwers for launching projectiles to improve their shooting skills.

Many projectile expelling apparatuses expel projectiles at various trajectories such as straight, rising, dropping, curving, sliding, and many other variable projectile directions. To adjust the projectile trajectory, some projectile apparatuses rotate the rotational expelling housing to change the spin direction of the projectile. Changing the projectile spin direction changes the trajectory of the projectile.

Frequently, projectile expelling apparatuses require a second person to feed projectiles into the apparatuses, however, some projectile expelling apparatuses include an automatic projectile dispensing mechanism. These projectile dispensing mechanisms automatically dispense projectiles into the projectile expelling apparatus allowing players to practice alone.

Some rotational projectile expelling apparatus designs vary projectile trajectory and include a projectile dispensing mechanism. Popular projectile expelling apparatus designs have various components configured to provide various features. Such components frequently include a stand (such as a tripod) for stabilizing the projectile expelling apparatus on a surface that may be level or not. Another popular component is an elevation adjustable mechanism connected to the stand enabling the adjustment of the projectile expelling housing for expelling the projectile upwardly, downwardly, or horizontally at increments. Yet another popular component is a rotatable housing mechanism such as disclosed in U.S. Pat. No. 7,958,876 titled "Projectile Expelling Apparatus" issued Jun. 14, 2011, that facilitates rotational adjustment of the projectile expelling housing to introduce various spin angles to the projectiles for throwing various trajectory pitches (e.g., straight, rising, dropping, curving, sliding, and other various projectile trajectories). Additionally, as mentioned above, a projectile dispensing mechanism, automated or not, to facilitate dispensing projectiles into the projectile expelling apparatus also is a desirable feature.

Problems have been encountered with known designs. Designs with fixed projectile dispensing mechanisms and having projectile expelling housings that are rotated and tipped for changing projectile trajectory encounter dispensing issues caused by the rotation and tipping of the fixed projectile dispensing mechanisms. Tipping the projectile dispensing mechanism can cause dispensing failure because the angle required for gravity to move projectiles into the dispensing mechanism is insufficient for proper projectile advancement. Also, the rotation and tipping can cause projectiles to fall out of the dispensing mechanism, rendering it inoperable.

Another type of problem is the destabilization of the projectile expelling apparatus during use that may cause errant or erratic throws. Projectile expelling apparatuses can be heavy and balanced precariously on an adjustable pedestal. Rotation and tilting of the projectile expelling apparatus, or component parts thereof, redistributes the weight load with respect to the stand (frequently a tripod) supporting the projectile expelling apparatus which tends to compromise stability of the overall system. The weight now unevenly distributed may cause the overall system to buck, jerk, or even overturn, when the recoil force of throwing a projectile is applied at a wrong angle due to the rotation and tipping. In this instance, the throws may become dangerously erratic.

BRIEF SUMMARY OF THE INVENTION

The present invention has been developed in response to the present state of the art, and particularly, in response to the problems and needs in the art that have not yet been fully solved by currently available projectile expelling apparatuses having a rotating expelling housing for expelling projectiles in various trajectories.

An exemplary projectile expelling apparatus of the present invention has a rotational expelling housing that includes a launch tube, a motor housing, a drive wheel housing, a feeder elbow, and a supporting stand. The launch tube has an ingress end, an exit end, and a drive wheel opening disposed proximate the ingress end. The feeder elbow has an entry end and an egress end. A rotational connector assembly connects the ingress end of the launch tube to the egress end of the feeder elbow in abutting rotational engagement, enabling a full 360° rotation of the launch tube about its longitudinal axis with respect to the feeder elbow. The motor housing houses the motor which is connected to a drive wheel that is housed within the drive wheel housing. The motor housing is connected to the drive wheel housing, and that combination is connected to the launch tube such that a portion of the drive wheel passes through the drive wheel opening into the interior of the launch tube to create a pinch region. When a projectile, such as a ball, is fed into the feeder elbow, the ball advances (via gravity and/or a propelling force) through the elbow feeder to the ingress end of the launch tube where it is grasped by the drive wheel to be carried through the pinch region and released to be expelled from the exit end of the launch tube. As the drive wheel releases the projectile from the pinch region, a pinching force and a driving force imparts spin to the projectile.

Of course, the spin imparting function may be provided by something other than a drive wheel. The drive wheel provides propulsion and imparts spin to projectiles that engage the rotating drive wheel. However, those skilled in the art recognize and understand that there are other ways to provide propulsion that may or may not impart spin to an expelled projectile. For example, there are projectile expelling devices that use moving air to provide propulsion that may or may not impart predictable spin to the expelled projectile. To impart spin to the projectile predictably with an air-propulsion projectile expelling device, a spin imparting structure may be provided. Examples of spin imparting structures may include the drive wheel that provides propulsion and imparts spin predictably for several of the embodiments disclosed herein, and for devices that do not use a drive wheel for propulsion such as an air-propulsion device the spin imparting structure may be a flap, a roller (biased or not), a ramp, or the like disposed within the launch tube or at or near the exit end of the launch tube. Embodiments using one or more spin imparting structures are contemplated by this disclosure and considered to be within the spirit and scope of the disclosed invention.

The spin imparted to the projectile determines the trajectory of the expelled/launched projectile. The type of spin imparted may be controlled by rotating the rotational expelling housing to position the exposed drive wheel to grasp the projectile at various differing locations along the surface of the projectile depending what type of spin and trajectory is desired. Rotation of the rotational expelling housing not only enables the full 360° rotation of the launch tube but also the exposed portion of the drive wheel. In an exemplary embodiment of the projectile expelling apparatus rotation of the launch tube is facilitated by a concentric mating assembly that allows unhindered advancement of projectiles to enter and exit the feeder elbow and to enter and exit the launch tube when the rotational expelling housing has been rotated to any position.

In some embodiments, the supporting stand is a tripod. The tripod comprises legs and a center column with a head. Connecting the tripod fixedly to the feeder elbow is a pivot adjustment assembly that facilitates tilt rotation about a pivot axis. For optimum stability, the pivot axis perpendicularly intersects the central longitudinal axis of a vertically disposed center column. Although optimum stability is not always necessary for the projectile expelling apparatus to operate acceptably, the closer the center column is disposed to vertical, the more stable the projectile expelling apparatus will be atop the supporting stand. The center column may be of a telescoping structure that enables height adjustment. However, that height adjustment feature is just an exemplary embodiment. Center column may be non-telescoping, non-height adjustable, or height adjustable without being telescoping.

Other exemplary projectile expelling apparatuses of the present invention may further comprise a projectile dispensing mechanism that may be fixed or adjustable and/or automatic or not. Projectile dispensing mechanisms may be attached to the feeder elbow in any suitable attachment to position the delivery of projectiles from the projectile dispensing mechanism into the entry end of the feeder elbow.

The features of the exemplary embodiments of the invention will become more fully apparent from the following description with reference to the drawings.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which.

Figure 1:
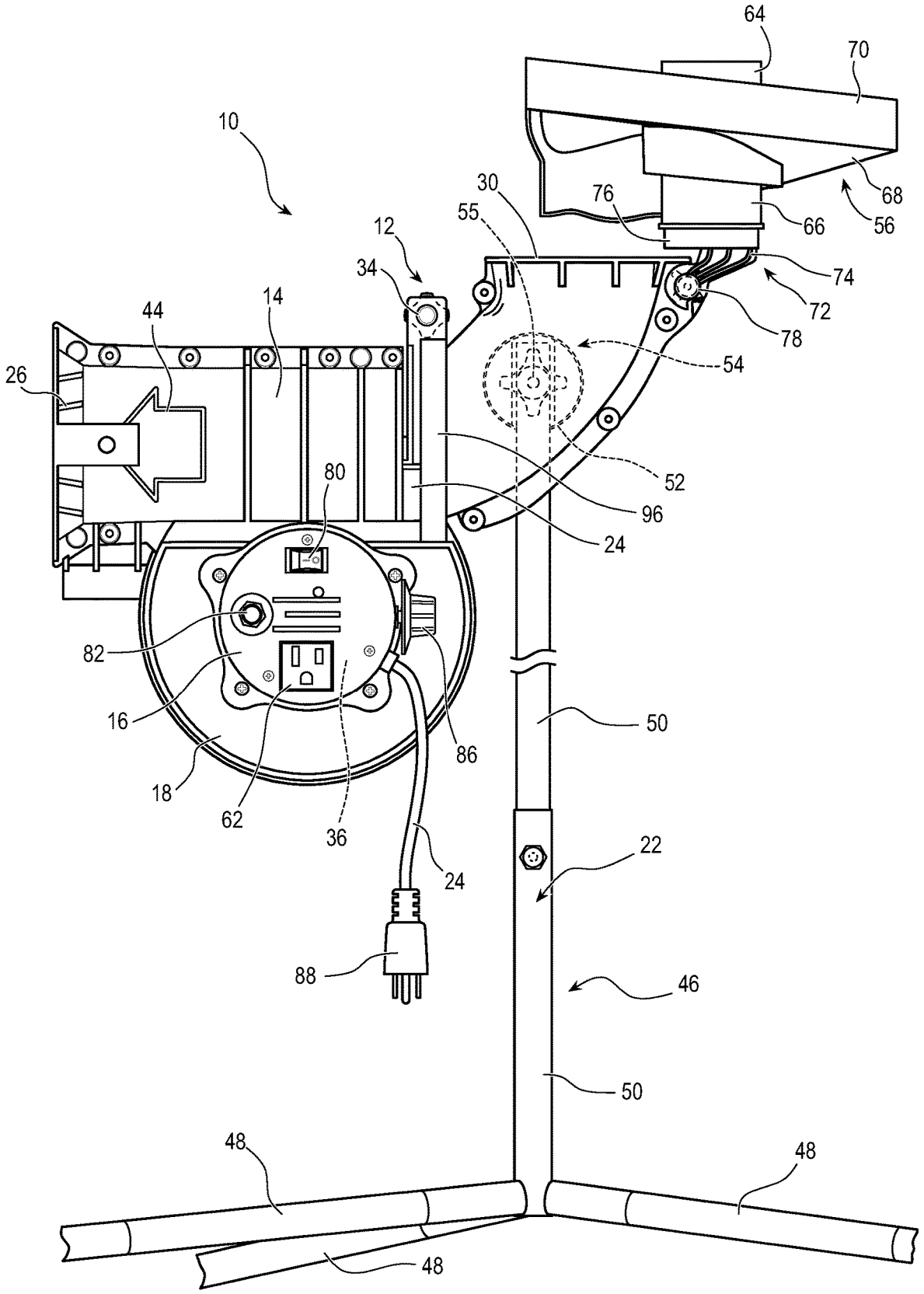
FIG. 1 is an elevational view of an exemplary projectile expelling apparatus configured for a horizontal launch and showing a side view with a launch direction arrow disposed proximate the exit end directed left.

REFERENCE NUMBERS projectile expelling apparatus 10
rotational expelling housing 12
launch tube 14
motor housing 16
drive wheel housing 18
feeder elbow 20
supporting stand 22 ingress end 24
exit end 26
drive wheel opening 28
entry end 30
egress end 32
rotational connector assembly 34
motor 36
drive wheel (spin imparting structure) 38
interior 40 (of the launch tube)
pinch region 42
launch direction arrow 44
tripod 46
legs 48
center column 50
head 52
pivot adjustment assembly 54
pivot axis 55
projectile dispensing mechanism 56
electrical cord 58
male plug 60
outlet 62
core 64
receiving cup 66
helical ramp 68
retaining wall 70
tilt-adjustable mounting hub 72
tiltable neck 74
hub head 76
tightening/loosening pivot pin 78
on/off switch 80
reset button 82
speed-adjustment knob 84
master electrical extension 86
master plug 88
projectile (or ball) 90
keyed slot 92
key 94
circular clamp 96
seam 98
anchor flange 100
clamping flange 102
threaded anchor bolt 104
hand knob 106
receiving disk 108
elongate recess 110
ceiling wall 112
parallel side walls 114
anchoring transverse column 116
pivot axis bolt 118
rotatable handle 120
first meshing teeth interface 122
second meshing teeth interface 124
resilient compression pad 126

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figure(s), is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

FIGS. 1-4 depict an exemplary projectile expelling apparatus 10 configured for a horizontal launch of a projectile. When configured as shown in FIGS. 1-4, projectile expelling apparatus 10 is in a base configuration; namely, unrotated and not tilted from the disposition that will result in a horizontal launch of a projectile. As depicted, projectile expelling apparatus 10 stands inert because it is not connected to power. Although, of course, the projectile expelling apparatus 10 may be connected to power and operated to expel projectiles as will be discussed below.

FIG. 1 is an elevational side view of the exemplary projectile expelling apparatus 10 configured for a horizontal launch of a projectile (not shown). As depicted, the side view of the projectile expelling apparatus 10 is shown directed left. The projectile expelling apparatus 10 generally comprises a rotational expelling housing 12 that includes a launch tube 14, a motor housing 16, a drive wheel housing 18, and a feeder elbow 20, and may be secured to and supported by a supporting stand 22. The launch tube 14 has an ingress end 24, an exit end 26, and a drive wheel opening 28 (best shown in FIG. 2) disposed proximate the ingress end 24. The feeder elbow 20 has an entry end 30 and an egress end 32. A rotational connector assembly 34 connects the ingress end 24 of the launch tube 14 to the egress end 32 of the feeder elbow 20 in abutting rotational engagement, enabling a full 360° rotation of the launch tube 14 about its longitudinal axis with respect to the feeder elbow 20.

Motor housing 16 houses the motor 36 (indicated as encased in the motor housing 16 by a phantom lead line) which is connected to a drive wheel 38 that is housed within the drive wheel housing 18. The motor housing 16 is connected to the drive wheel housing 18, and that combination is connected to the launch tube 14 such that a portion of the drive wheel 38 passes through the drive wheel opening 28 into the interior 40 of the launch tube 14 to create pinch region 42 (best shown in FIG. 2). A launch direction arrow 44 is disposed on the launch tube 14 proximate to exit end 26 of the launch tube 14 to indicate the direction in which projectiles will be expelled from projectile expelling apparatus 10. Projectile expelling apparatus 10 is in the base configuration, configured for a horizontal launch, when the feeder elbow 20 is not tilted from a horizontal feed of the projectile into the launch tube 14 and the launch tube 14 is unrotated from having the drive wheel 36 subtending and vertically aligned with the longitudinal axis of the launch tube 14.

Because various components of the projectile expelling apparatus 10 may be configured in different relationships to each other (non-base configurations), the expulsion direction may change as the configuration of the projectile expelling apparatus 10 changes as will be explained below. Any configuration of projectile expelling apparatus 10 that has the launch tube 14 rotated away from the base configuration and/or tilted away from the base configuration is a non-base configuration.

The supporting stand 22, depicted in FIG. 1 and throughout the drawings, is a tripod 46; however, the supporting stand 22 need not be a tripod 46. Any type of supporting stand 22, whether a post, a post with a horizontal swivel top, a pedestal, a table, or the like, to which the projectile expelling apparatus 10 may be secured without inhibiting its configurational versatility may serve as the supporting stand 22. As depicted, tripod 46 comprises legs 48 and a center column 50 with a head 52. Connecting the tripod 46 fixedly to the feeder elbow 20 is a pivot adjustment assembly 54 (shown in phantom lines in FIG. 1) that facilitates tilt rotation about a pivot axis 55 (extending perpendicularly out from the drawing page towards the viewer). For optimum stability, the pivot axis 55 perpendicularly intersects the central longitudinal axis (not shown) of a perfectly vertically disposed center column 50. Of course, the connection of the tripod 46 to the pivot adjustment assembly 54 need not always have such optimum stability, but the closer the center column 50 is disposed to vertical, the more stable the projectile expelling apparatus 10 will be atop the supporting stand 22. Also, the center column 50 is shown throughout the drawings as telescoping that enables height adjustment. However, that height adjustment feature is just an exemplary embodiment. Center column 50 may be non-telescoping, non-height adjustable, or height adjustable without being telescoping.

Furthermore, the stability of the projectile expelling apparatus 10 is also enhanced because the pivot axis 55 and pivot adjustment assembly 54 may be rearwardly disposed at the feeder elbow 20. All meaningful tilting adjustments may be accomplished by tilting upward or downward without tilting beyond the verticality of the supporting stand 22. This also enables legs 48 of tripod 46 to be positioned so that the pivot axis 55 is not required to be at the center of mass of projectile expelling apparatus 10 and the recoil of the projectile expelling apparatus 10 upon expulsion of a projectile is more easily absorbed.

Figure 2:
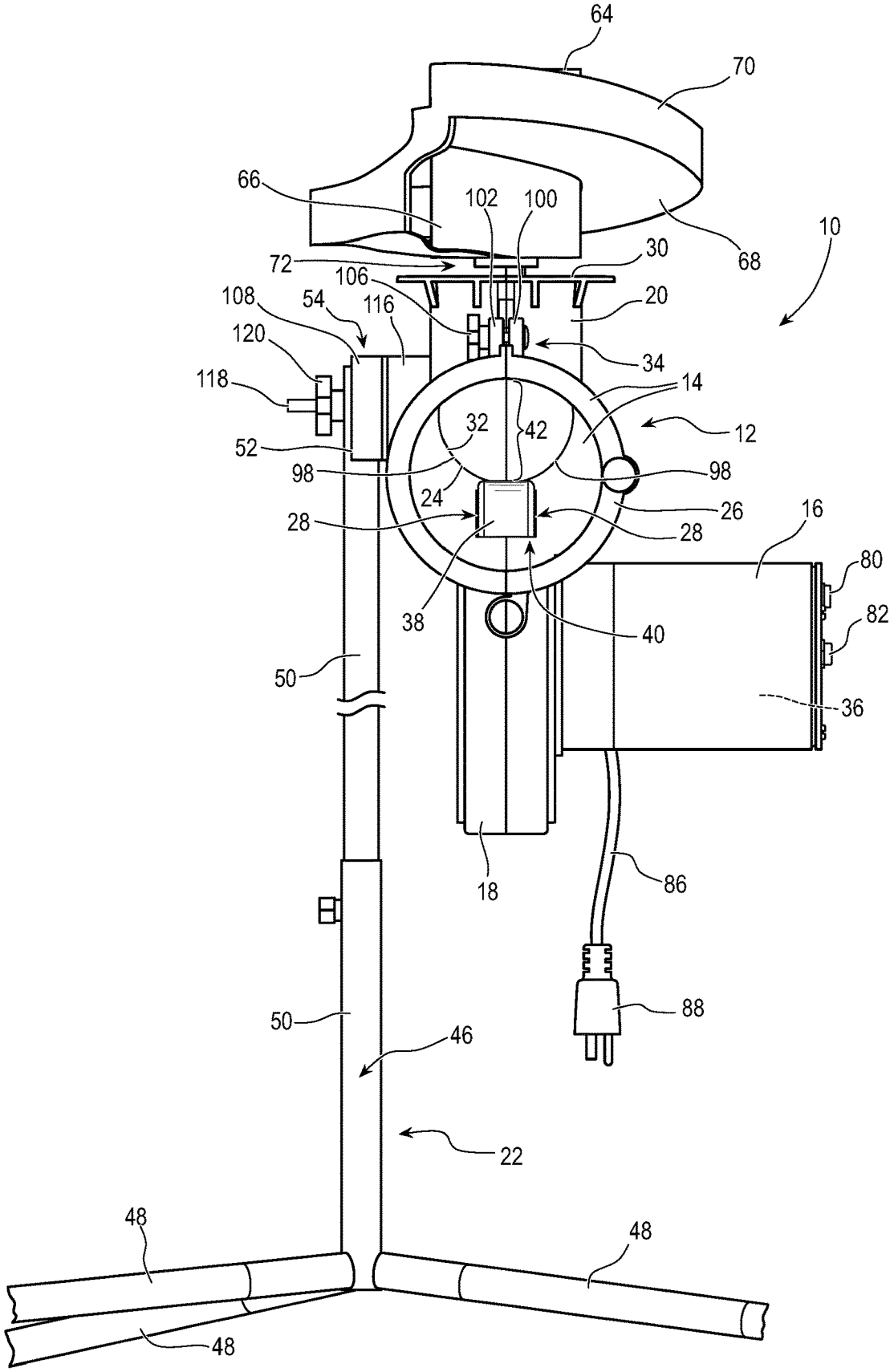
FIG. 2 is an elevational end view of the exemplary projectile expelling apparatus of FIG. 1 configured for a horizontal launch and showing the drive wheel within the launch tube.
Figure 3:
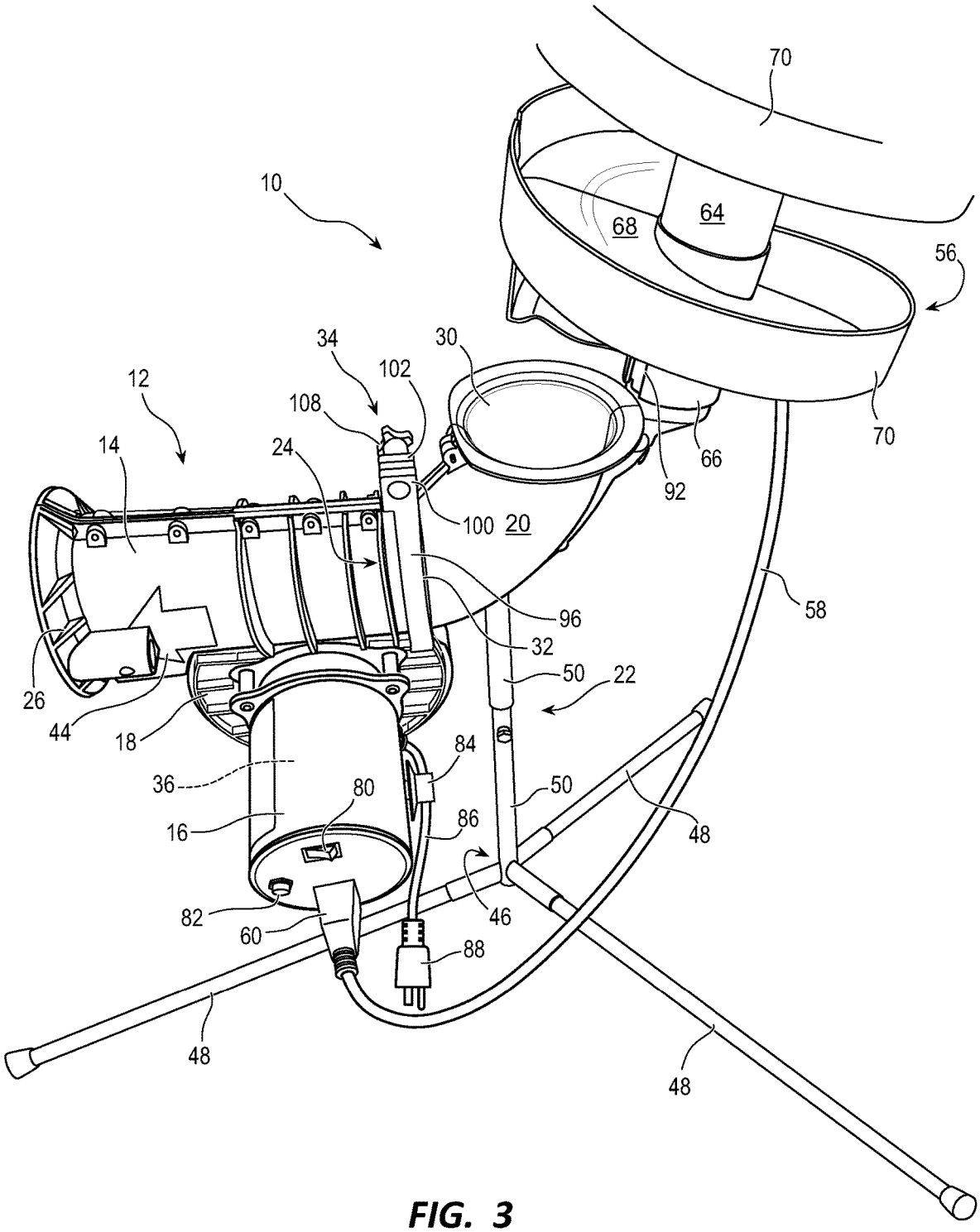
FIG. 3 is a perspective view of the exemplary projectile expelling apparatus of FIG. 1 configured for a horizontal launch and showing an elevated view of the entry end of the feeder elbow and the automatic dispenser connected to a power outlet on the motor housing.

FIGS. 1-4 show an optional projectile dispensing mechanism 56 mounted onto the projectile expelling apparatus 10. Projectile dispensing mechanisms 56 may be manual or automatic or a both, in combination, but as depicted, the projectile dispensing mechanism 56 is automatic or the combination because an electrical cord 58 and male plug 60 is shown in FIG. 3 as plugged into an outlet 62 (shown on FIG. 1) on the motor housing 16. Projectile dispensing mechanism 56 comprises a core 64 with a receiving cup 66, a helical ramp 68, a retaining wall 70, a projectile advancing control (not shown). The projectile advancing control may be one of many types; for example, a movable stop, a rotatable stop, stop retractable trigger, and the like.

A tilt-adjustable mounting hub 72 may be disposed at the entry end 30 of the feeder elbow 20. The tilt-adjustable mounting hub 72 comprises a tiltable neck 74 connected between a hub head 76 and a tightening/loosening pivot pin 78. The receiving cup 66 may receive the hub head 76 in a snug-fitting engagement. When loosened, the tiltable neck 74 pivots about the tightening/loosening pivot pin 78, and when tightened, the tiltable neck 74 is secured into a tilt angle, thereby imparting the tilt angle to the to the projectile dispensing mechanism 56 and altering the angle of the helical ramp 68.

Tipping, tilting, or reorienting the projectile dispensing mechanism 56 can cause dispensing failure because the angle of the helical ramp 68 required for gravity to advance projectiles may be insufficient. Also, the projectile expelling apparatus 10 with the projectile dispensing mechanism 56 affixed may cause projectiles to fall out of the projectile dispensing mechanism 56, rendering it inoperable to properly feed projectiles into feeder elbow 20. The tilting capability of the tilt-adjustable mounting hub 72 serves to compensate for the tilting movement of the projectile expelling apparatus 10 by counter-tilting the tilt-adjustable mounting hub 72 so that the mounted projectile dispensing mechanism 56 is properly positioned to feed projectiles into the feeder elbow 20 and maintains an angle sufficient for advancing projectiles along the helical ramp 68 and/or an orientation that constrains projectiles to travel the helical ramp 68 without falling out of the projectile dispensing mechanism 56.

User control of the projectile expelling apparatus 10 may be manual or remotely controlled via wireless communication like what is used to control remote-controlled vehicles such as toy cars, boats, and drones. By way of example and as depicted in FIGS. 1 and 3, manual controls are shown of the motor housing 16, including but not limited to, an outlet 62, an on/off switch 80, a reset button 82, a speed-adjustment knob 84, and a master electrical extension 86 with a master plug 88. Of course, the master plug 88 may be connected to a power source (not shown) to supply electrical power along the master electrical extension 86 to the motor 36 and to outlet 62. When connected to power, the on/off switch 80 controls whether the motor 36 is operable or not, and when operable, the speed-adjustment knob 84 controls the rotation speed of the drive wheel 38 that imparts speeds and spins to the expelled projectile relative to the rotation speed of the drive wheel 38 and the angle at which the drive wheel 38 engages and pinches the projectile. If the drive motor 38 requires a reset, despite receiving power, the reset button 82 may be pressed to initiate a reset of the drive motor 38.

When a projectile 90 (shown in FIG. 4), such as a ball 90, is fed into the feeder elbow 20, the ball 90 advances (via gravity and/or a propelling force) into and through the feeder elbow 20 to the ingress end 24 of the launch tube 14 where it is grasped and pinched by the drive wheel 38 to be carried through the pinch region 42 and released to expel from the exit end 36 of the launch tube 14. As the drive wheel releases projectile 90 from the pinch region 42, the pinching force and the driving force of the drive wheel 38 imparts spin to the projectile 90. That spin dictates whether the projectile 90 travels straight, curves one direction or another (a slider), rises, drops, or in some instances dances (changes direction during flight).

As mentioned above, the spin imparting function may be provided by something other than drive wheel 38. Drive wheel 38 provides propulsion and imparts spin to projectiles 90 that engage the rotating drive wheel 38. However, those skilled in the art recognize and understand that there are other ways to provide propulsion that may or may not impart spin to an expelled projectile 90. For example, there are projectile expelling devices that use moving air to provide propulsion that may or may not impart predictable spin to the expelled projectile 90. To impart spin to the projectile 90 predictably with an air-propulsion projectile expelling device, a spin imparting structure (e.g., drive wheel 38 or some other structure) may be provided. Examples of spin imparting structures include the drive wheel 38 that provides propulsion and imparts spin predictably for several of the embodiments disclosed herein, and for devices that do not use a drive wheel for propulsion such as an air-propulsion device the spin imparting structure may be a flap, a roller (biased or not), a ramp, or the like disposed within the launch tube or at or near the exit end of the launch tube. Embodiments using one or more spin imparting structures are contemplated by this disclosure and considered to be within the spirit and scope of the disclosed invention. In the interest of brevity, non-drive wheel embodiments have not been depicted because drive wheel 38 (as depicted in FIG. 2) depicts a roller that would impart spin to a projectile 90 passing through the launch tube 14 if the projectile were to be propelled other than by a motor 36 rotated drive wheel 38.

FIG. 1 is a depiction of a stable horizontal configuration of the exemplary projectile expelling apparatus 10 with center column 50 of the supporting stand 22 disposed vertically, the launch tube 14 disposed horizontally, the pivot adjustment assembly 54 is disposed transversely such that the feeder elbow 20 has its entry end 30 disposed horizontally and its egress end 32 disposed vertically, and the tilt-adjustable mounting hub 72 is secured such that the central axis of the hub head 76 is disposed vertically and the upper surface of the hub head 76 is disposed horizontally so that the projectile 90 will feed properly into the feeder elbow 20. In this configuration, absent defects on the projectile 90, defects on the drive wheel 38, and/or windy conditions, the projectile 90 will be expelled straight along a horizontal plane and gradually fall from horizontal under the effect of gravity.

FIG. 2 is also a depiction of a stable horizontal configuration (base configuration) of the exemplary projectile expelling apparatus 10. With the frontal view of FIG. 2, it is shown that the drive wheel housing 18, the launch tube 14, the drive wheel 38, the feeder elbow 20, and the optional projectile dispensing mechanism 56 align vertically with each other and vertically parallel to the vertically disposed center column 50 of the supporting stand 22. Again, in this configuration, absent defects on the projectile 90, defects on the drive wheel 38, and/or windy conditions, the projectile 90 will be expelled straight along a horizontal plane and gradually fall from horizontal under the effect of gravity.

FIG. 3 offers a slightly different perspective view of the same stable horizontal configuration of the exemplary projectile expelling apparatus 10, showing how the legs 48 of the tripod 46 may be extended to provide optimum stability, and shows how the receiving cup may have a keyed slot 92 and the hub head 76 may have a key 94 to prevent the projectile dispensing mechanism 56 from rotating undesirably on its mount.

Figure 4:
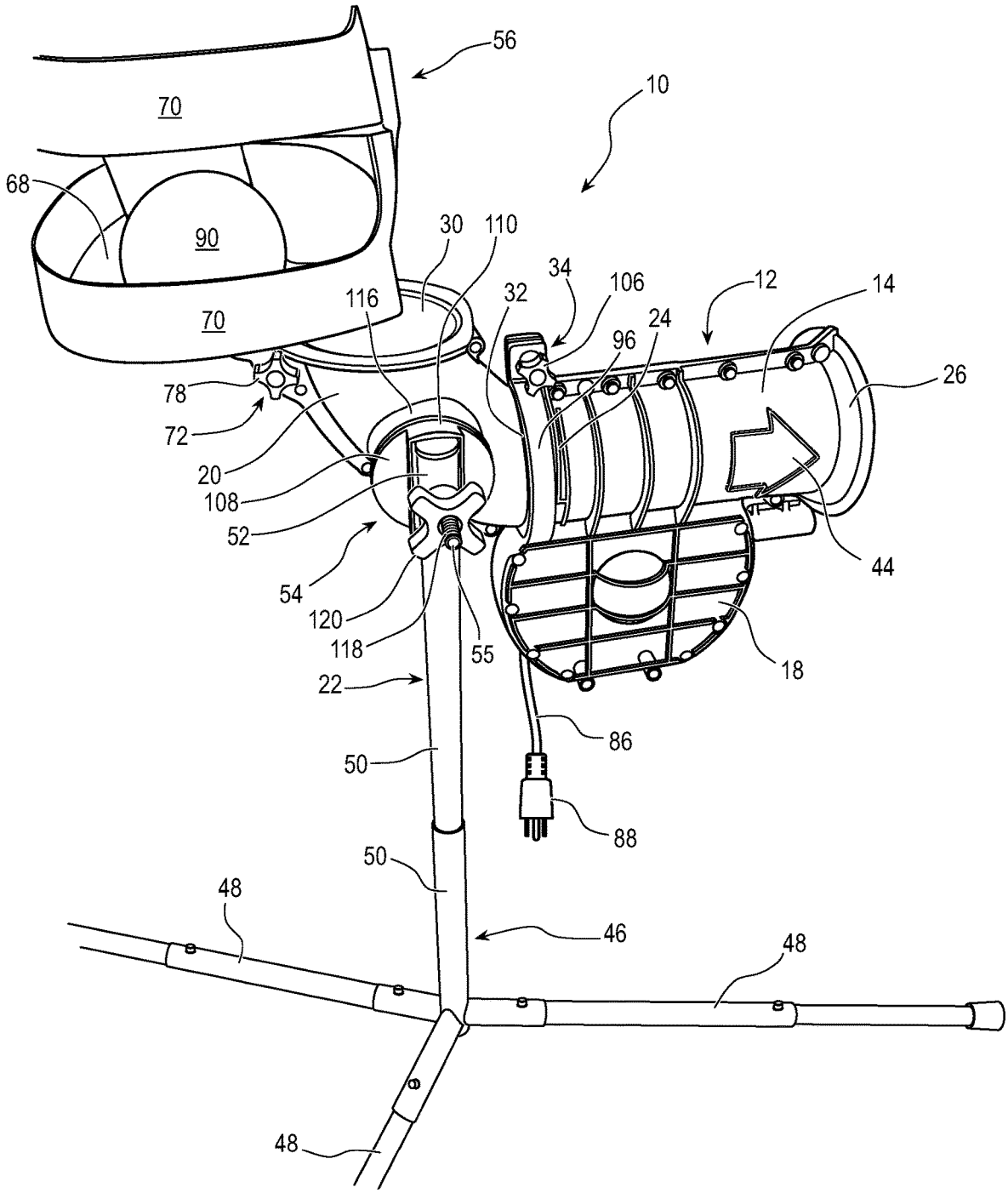
FIG. 4 is a perspective view of the exemplary projectile expelling apparatus of FIG. 1 configured for a horizontal launch and showing a launch direction arrow proximate the exit end directed right and a rearwardly-disposed pivot adjustment assembly.

FIG. 4 offers another perspective view of the same stable horizontal configuration of the exemplary projectile expelling apparatus 10 (for purposes of this disclosure the stable horizontal configuration depicted is sometimes identified as a base configuration), showing a projectile 90 stopped and staged for release into the entry end 30 of the feeder elbow 20 and the relative dispositions of the rotational connector assembly 34 for rotating the launch tube 14 (together with the motor housing 16 (not shown) and the drive wheel housing 18 relative to the feeder elbow 20, the pivot adjustment assembly 54 for rotational tilting the pivot adjustment assembly 54 upward or downward relative to the supporting stand 22, and the tilt-adjustable mounting hub 72 for rotational counter-tilting the projectile dispensing mechanism 56 relative to the rotational tilting the pivot adjustment assembly 54 so that the projectile dispensing mechanism 56 is properly positioned to feed projectiles 90 into the feeder elbow 20.

By rotating and/or tilting the various components of the projectile expelling apparatus 10, the projectile expelling apparatus 10 may be reconfigured into numerous non-base configurations while maintaining adequate stability, wherein each of these non-base configurations will affect the trajectory of the projectile 90 being expelled. One non-base configuration may expel the projectile 90 in a curveball trajectory, while a slightly different non-base configuration may expel the projectile 90 is a somewhat flat curveball trajectory, and by altering the speed of the drive wheel 38, a new trajectory may be a slow curve or a hard breaking curve. Exemplary configurations (base configuration and non-base configurations) of the projectile expelling apparatus 10, each expelling projectile 90 at various trajectories are disclosed and described below.

Figure 5:
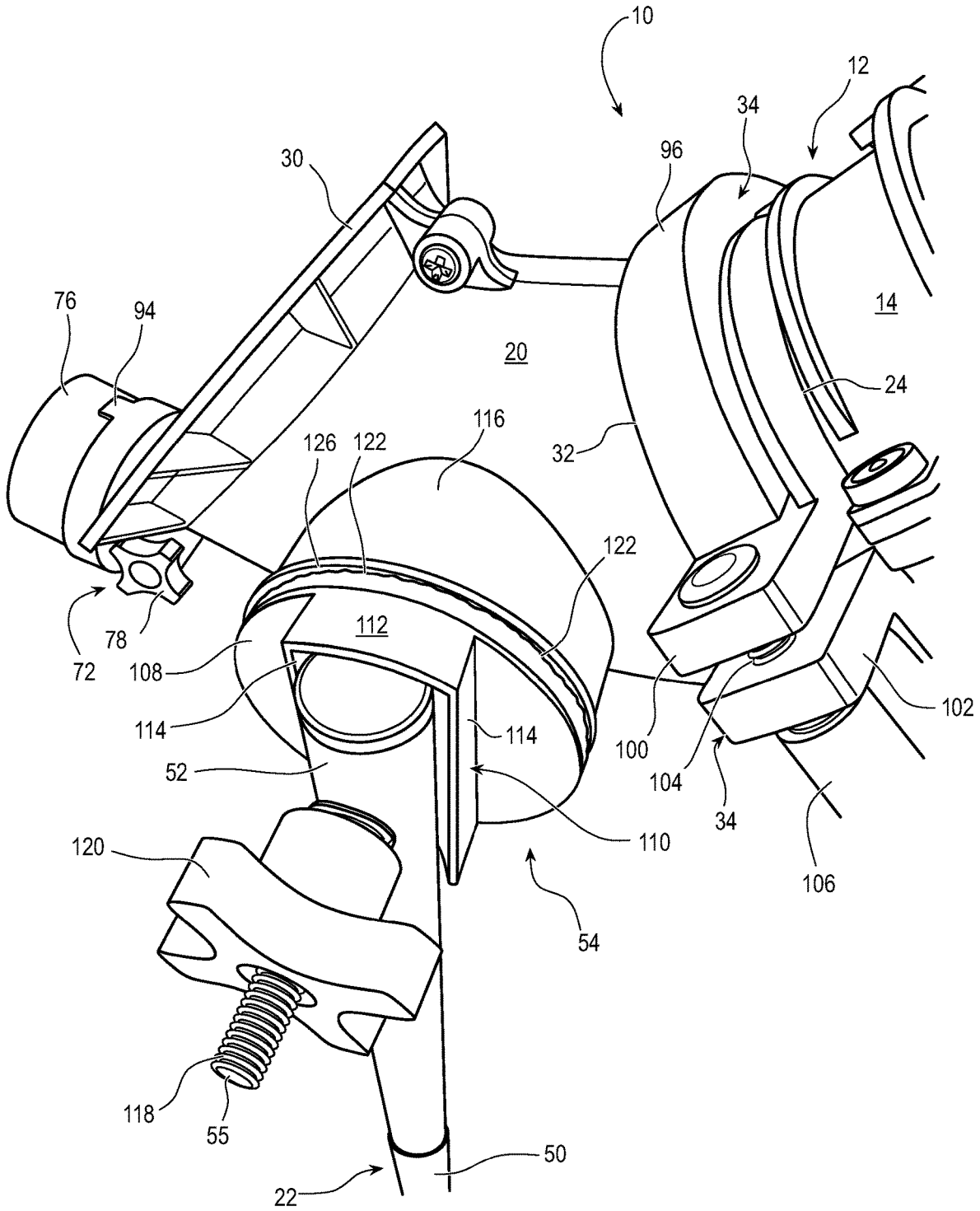
FIG. 5 is a perspective view of the rearwardly-disposed pivot adjustment assembly disposed at the feeder elbow and showing the rotational connection assembly, the automatic dispenser having been removed.

FIG. 5 is an enlarge perspective view of a portion of another exemplary configuration of the projectile expelling apparatus 10 showing a portion of the rotational connector assembly 34, pivot adjustment assembly 54, and the tilt-adjustable mounting hub 72 (without the optional projectile dispensing mechanism 56 attached). With this exemplary embodiment, the launch tube is tilted upward.

Figure 6:
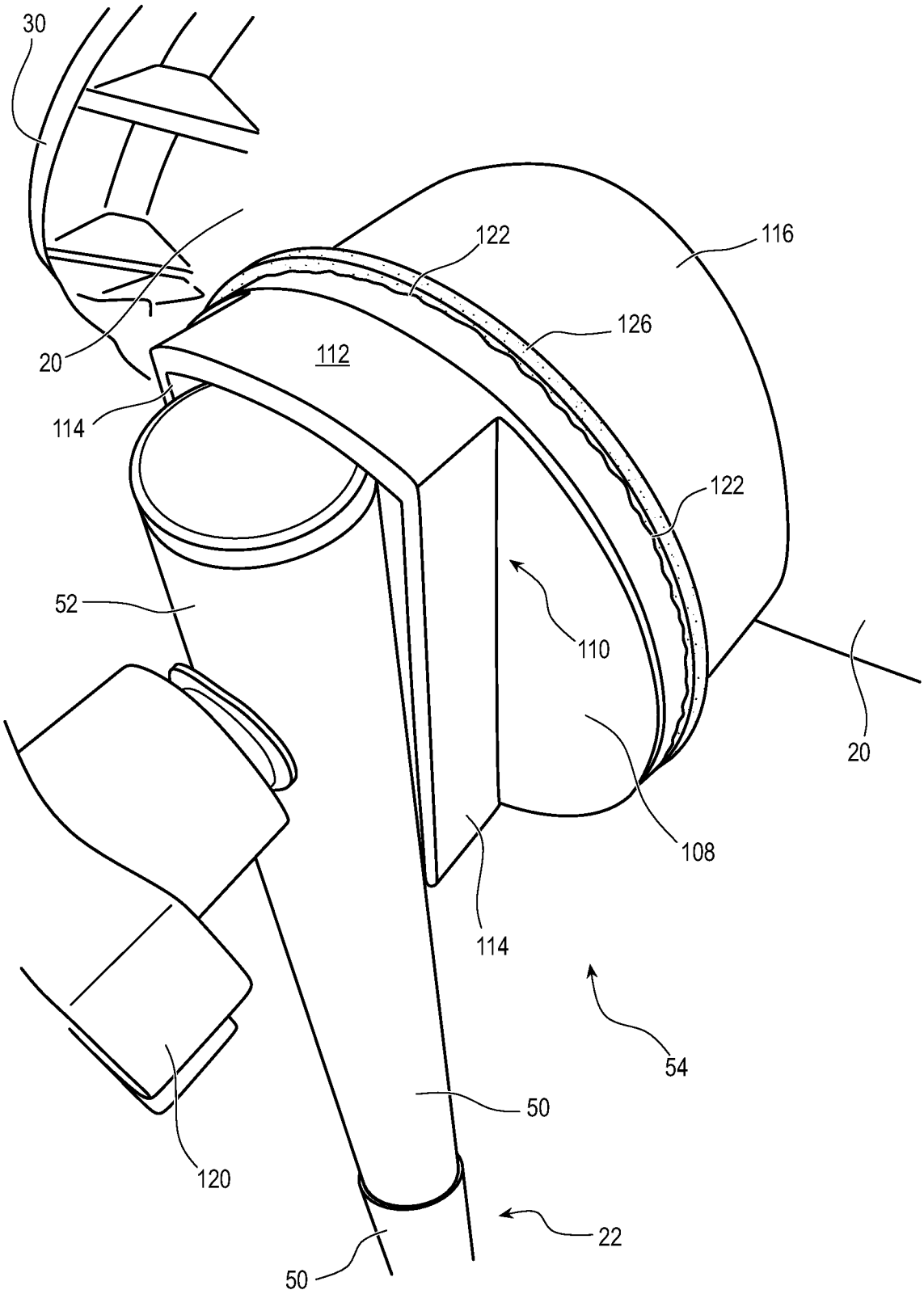
FIG. 6 is an enlarged perspective view of the rearwardly-disposed pivot adjustment assembly showing the head of the center column nesting within an elongate recess.
Figure 7:
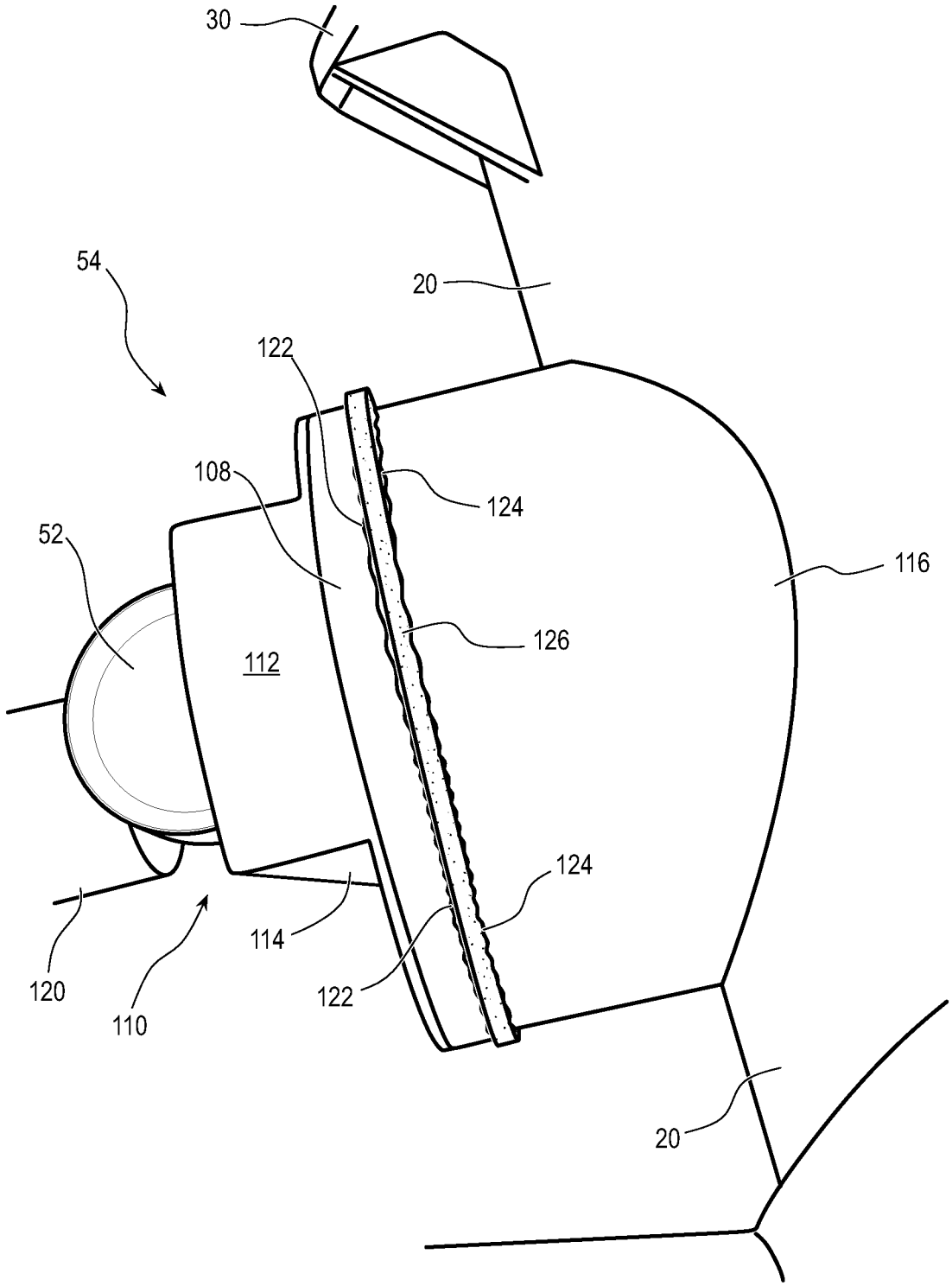
FIG. 7 is an enlarged overhead view of the rearwardly-disposed pivot assembly showing first meshing teeth interface and second meshing teeth interface separated by a resilient compression pad.

As configured in each of the FIGS. 1-12, projectile expelling apparatus 10 is depicted in a secured mode because the rotational connector assembly 34 has been tightened to prevent rotation of the launch tube 14 and except for FIGS. 5-7, projectile expelling apparatus 10 is depicted in a non-tiltable mode because the pivot adjustment assembly 54 has been tightened to prevent tilting of the feeder elbow 20. When the rotational connector assembly 34 is loosened sufficiently to permit and facilitate rotation of the launch tube 14, projectile expelling apparatus 10 is in the rotation mode permitting the projectile expelling apparatus 10 to be moved from one configuration to another (for example, from the base configuration to one of the non-base configurations, or from one non-base configuration to another non-base configuration, or from one non-base configuration to the base configuration). When the pivot adjustment assembly 54 is loosened sufficiently to permit and facilitate tilting of feeder elbow 20 (as depicted in FIGS. 5-7), projectile expelling apparatus 10 is in the tiltable mode permitting the projectile expelling apparatus 10 to be tilted upward or downward from one configuration to another. Because tilting of the feeder elbow 20 may be done independent of rotating the launch tube innumerable non-base configurations are possible while still maintaining stability and versatility of the projectile expelling apparatus 10.

As depicted in FIG. 5, rotational connector assembly 34 is shown to be a circular clamp 96 adapted to capture the ingress end 24 of the launch tube 14 and the egress end 32 of the feeder elbow 20 in flush matching end-to-end abutting engagement so that the seam 98 (shown in FIG. 2) between the feeder elbow 20 and the launch tube 14 does not impede or alter the smooth rolling travel of the projectile from the feeder elbow 20 to the launch tube 14. The rotational connector assembly 34 also assures that seam 98 remains smooth, circularly aligned, and unimpeding through the full rotation of the launch tube 20.

The circular clamp 96 comprises an anchor flange 100, a clamping flange 102, a threaded bolt 104 secured to the anchor flange 100 and in pass-through engagement with the clamping flange 102, and a hand knob 106 for tightening and loosening the circular clamp 96. By advancing threadedly the hand knob 106 against the clamping flange 102 to reduce the inner circumference of the circular clamp 96 to capture and secure the feeder elbow 20 to the launch tube 14 from movement relative to each other, the circular clamp 96 is tightened and secured (placing the projectile expelling apparatus 10 in the secured mode). By retracting threadedly the hand knob 106 from the clamping flange 102 the inner circumference of the circular clamp 96 expands releasing the feeder elbow 20 to the launch tube 14 from captured securement, permitting movement relative to each other (placing the projectile expelling apparatus 10 in the rotation mode). The circular clamp 96 loosened facilitates the rotation of the launch tube 14.

As mentioned above, the launch tube 14 is capable of a full 360° rotation. The circular clamp 96 makes it possible to capture and secure the launch tube 14 at any angle within those 360° of rotation. At each of those angles, the projectile 90 will encounter the drive wheel 38 differently than at every other angle, thereby imparting different spin to the projectile 90.

Pivot adjustment assembly 54 facilitates tilt rotation about a pivot axis 55 to move the launch tube 14 about that pivot axis 55 in a vertical plane upward and downward, constrained only by practical use of the projectile expelling apparatus 10 or physical contact with a portion of the supporting stand 22 or the ground. For example, it makes little sense to expel a projectile straight up or straight down or to tilt the device into the ground or a portion of the supporting stand 22. Pivot adjustment assembly 54 is capable of tilt rotation of the full range of angles between straight up and straight down. At each of those angles, the projectile 90 will encounter the force of gravity on the projectile 90 at a different angle and each different angle may change the spin (either adding or subtracting from the spin) or the overall trajectory of the projectile based on the angular pull of gravity against the projectile.

Pivot adjustment assembly 54, as depicted in FIGS. 5-7, comprises a receiving disk 108 with a raised-wall elongate recess 110 having a ceiling wall 112 and parallel side walls 114, an anchoring transverse column 116 having a longitudinal axis coincident to the pivot axis 55 and a threaded pivot axis bolt 118 anchored thereto aligning with the pivot axis 55, a rotatable handle 120 that threadedly engages the threaded pivot axis bolt 118. The head 52 of the center column 50 has a bore (not shown specifically, but implied) through which the threaded pivot axis bolt 118 passes. The threaded pivot axis bolt 118 also passes through the receiving disk 108 so that head 52 may be snugly nested within the elongate recess 110 between the rotatable handle 120 and receiving disk 108. By advancing threadedly the rotatable handle 120 against head 52, head 52 is forced against the receiving disk 108 within the elongate recess 110 to capture and secure head 52 within the elongate recess 110 and clamps the receiving disk 108 against anchoring transverse column 116. In this manner the supporting stand 22 and the receiving disk 108 portion of the pivot adjustment assembly 54 is tightened and secured to the anchoring transverse column 116.

To enhance securement and prevent tilt slippage during operation between the receiving disk 108 and the anchoring transverse column 116, additional features may be employed. For example, the receiving disk 108 may have a first meshing teeth interface 122 and the anchoring transverse column 116 may have a second meshing teeth interface 124, the teeth interfaces mesh to prevent tilting rotation of the receiving disk 108 relative to the anchoring transverse column 116, and to reduce frictional wear on the teeth, a resilient compression pad 126 may be disposed between the meshing teeth interfaces 122, 124. FIG. 7 depicts an enlarged overhead view of the pivot adjustment assembly 54 showing first meshing teeth interface 122 and second meshing teeth interface 124 separated by the resilient compression pad 126.

By retracting threadedly the rotatable handle 120 from head 52, the pivot adjustment assembly 54 may be loosened sufficiently to permit anchoring transverse column 116 to rotate relative to receiving disk 108 without releasing head 52 from within its nesting disposition with elongate recess 110. In this manner, the anchoring transverse column 116 may rotate to allow the rotational expelling housing 12 to freely tilt rotationally. FIG. 6 depicts head 52 of center column 50 as a snapshot of alternative events, either beginning of nesting into elongate recess 110 by tightening pivot adjustment assembly 54 or the loosening of the pivot adjustment assembly 54 wherein 52 has not been fully released from its nesting within elongate recess 110.

Tilt-adjustable mounting hub 72, shown without the optional projectile dispensing mechanism 56 attached, is best shown in FIG. 5. When tilt-adjustable mounting hub 72 is loosened, tiltable neck 74 may pivot about the tightening/loosening pivot pin 78, and when tightened, the tiltable neck 74 is secured into a tilt angle. By changing the tilt angle of the rotational expelling housing 12 such as tilting upward as shown in FIG. 5, the tilt-adjustable mounting hub 72 may require adjustment to a new tilt angle so that a projectile dispensing mechanism 56 will operate properly. Because the tilt-adjustable mounting hub 72 is adjustable, it may be tilted so that the optional projectile dispensing mechanism 56 may be used in more configurations of the projectile expelling apparatus 10.

Turning now to FIGS. 8-12, various exemplary configurations of the projectile expelling apparatus 10 are depicted and each is a representative example of projectile expelling apparatus 10 in a non-base configuration. Each of FIGS. 8-12 depict only representative examples of possible configurations (base configuration or non-base configurations), but there are many (innumerable) incrementally different configurations that are contemplated by this disclosure and fall within the spirit and scope of the invention disclosed and claimed herein. Each incrementally different configuration of the rotational expelling housing 12 will expel projectiles 90 on different trajectories, and those trajectories may also change when expelled at different speeds (the motor 38 has a speed control, speed-adjustment knob 84).

Figure 8:
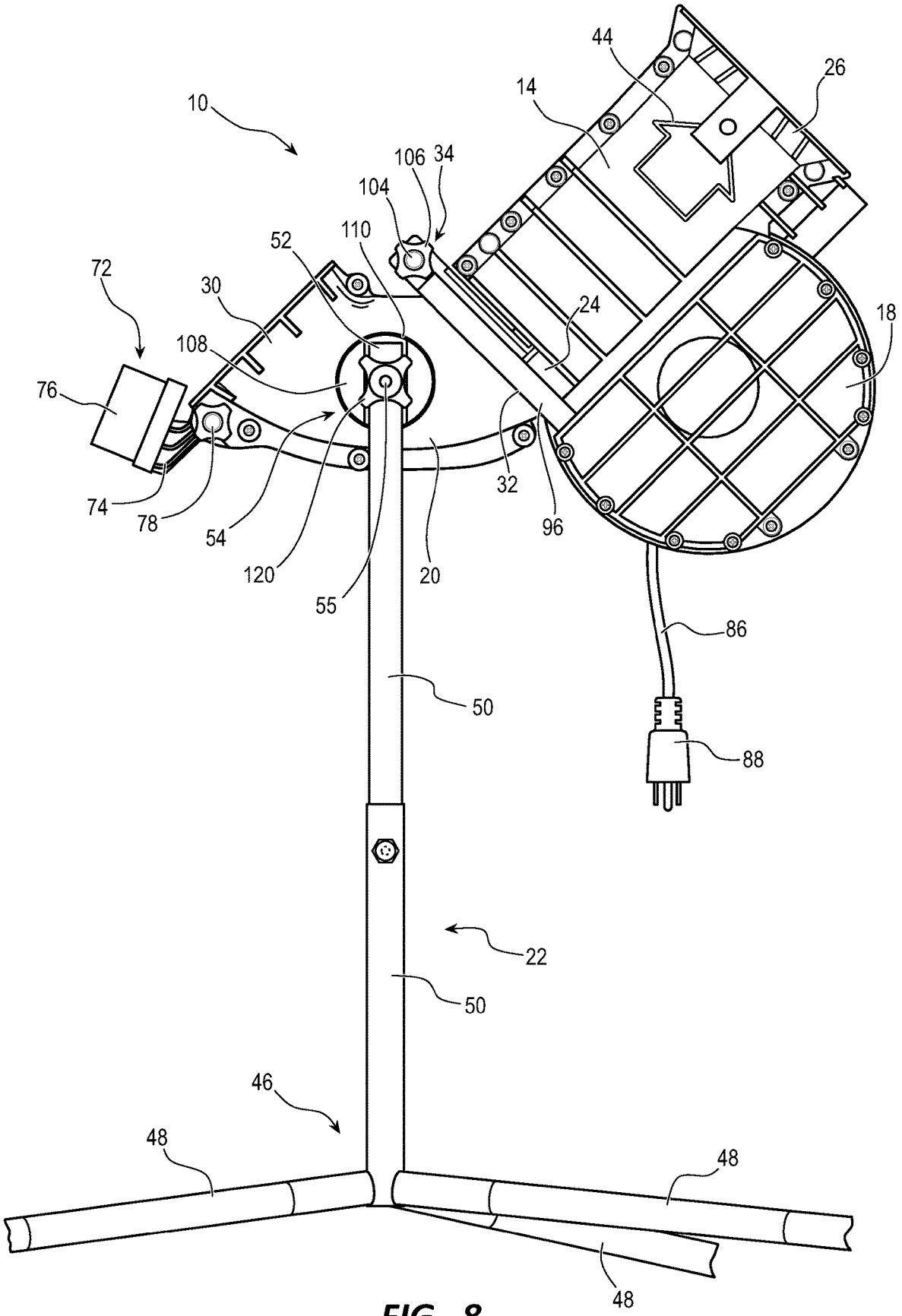
FIG. 8 is an elevational view of another exemplary projectile expelling apparatus configured for an upward launch, with the automatic dispenser removed, and showing a side view with a launch direction arrow proximate the exit end directed upwardly to the right, the rearwardly-disposed pivot adjustment assembly is shown securing the projectile expelling apparatus for an upward launch.

FIG. 8 is an elevational view of an exemplary configuration of projectile expelling apparatus 10 configured for an upward launch, with the optional projectile dispensing mechanism 56 removed. With this configuration, the launch tube 14 remains in the rotational disposition used for a horizontal launch as depicted in FIG. 2 (the configuration depicted in FIG. 2 would likely have a fast ball trajectory). However, the rotational expelling housing 12 has been rotationally tilted upward about pivot axis 55. The spin imparted to the projectile 90 will be approximately the same as a horizontal launch, but gravity will affect the trajectory differently than with a horizontal launch. Generally, depending upon the speed at which the projectile 90 is expelled, this configuration may expel the projectile at a pop-up or a fly ball trajectory.

Figure 9:
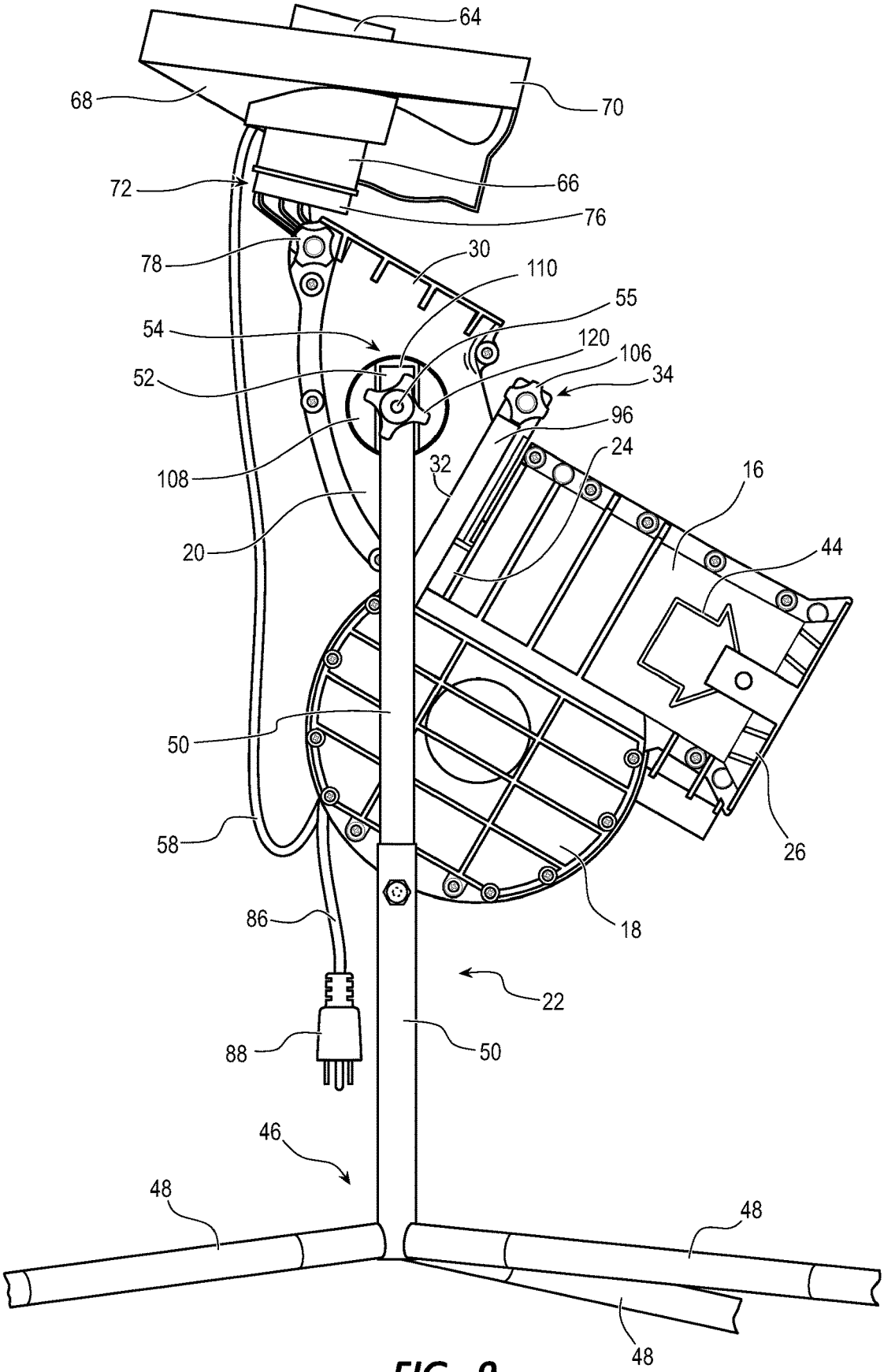
FIG. 9 is an elevational view of another exemplary projectile expelling apparatus, with the automatic dispenser attached, configured for a downward launch, and showing a side view with a launch direction arrow proximate the exit end directed downwardly to the right, the rearwardly-disposed pivot adjustment assembly is shown securing the projectile expelling apparatus for a downward launch.

FIG. 9 is an elevational view of another exemplary configuration of projectile expelling apparatus 10, with the optional projectile dispensing mechanism 56 attached and tilted to properly feed projectiles 90 into feeder elbow 20. With this configuration, the launch tube 14 remains in the rotational disposition used for a horizontal launch as depicted in FIG. 2. However, the rotational expelling housing 12 has been rotationally tilted downward about pivot axis 55. The spin imparted to the projectile 90 will be approximately the same as a horizontal launch, but gravity will affect the trajectory differently than with a horizontal launch. Generally, depending upon the speed at which the projectile is expelled, this configuration may expel the projectile 90 at a soft ground ball or a hard ground ball trajectory.

Figure 10:
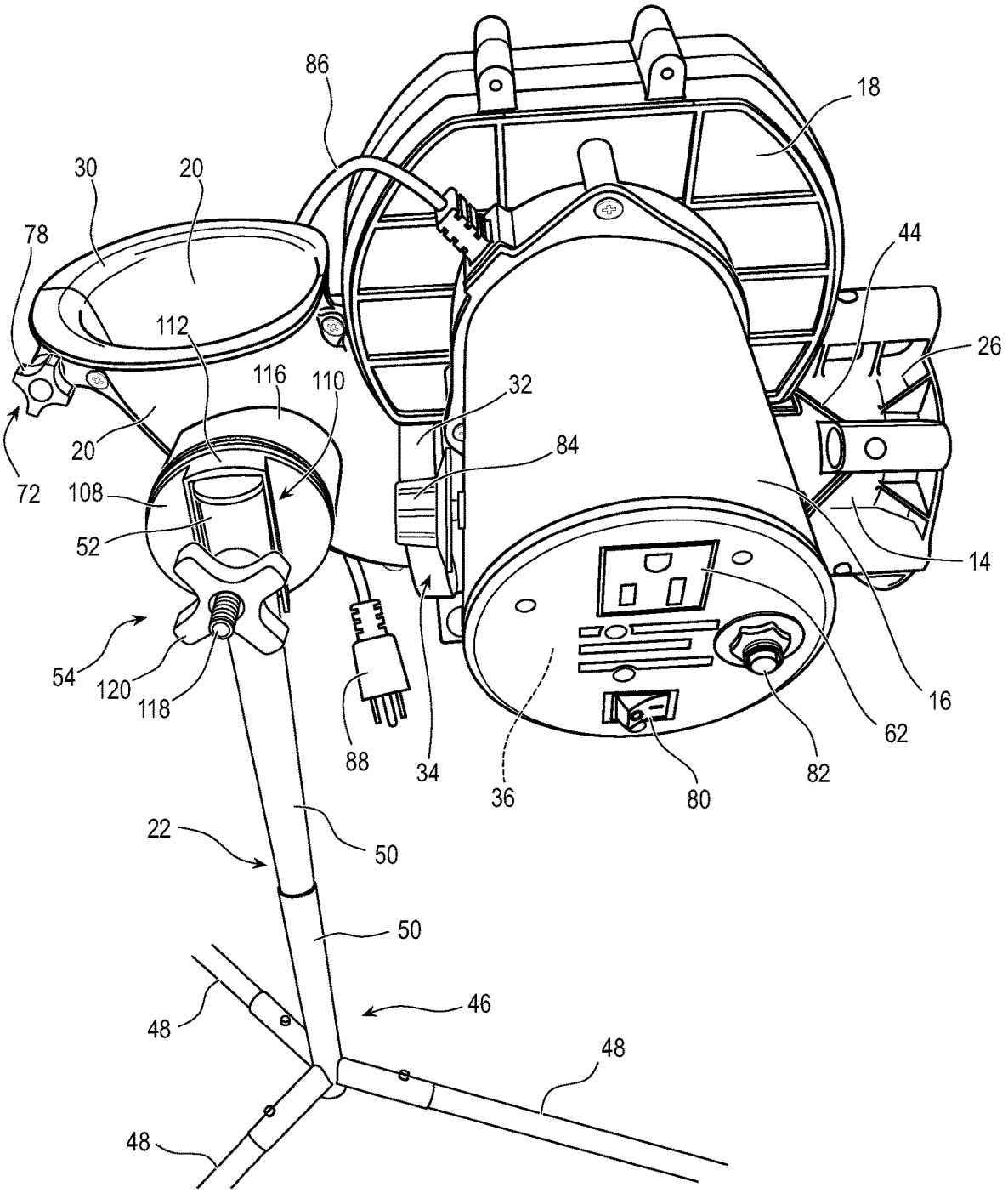
FIG. 10 is a perspective view of the exemplary projectile expelling apparatus with the pivot adjustment assembly securing the horizontal disposition of the launch tube and showing the rotational connection assembly rotated such that the launch tube subtends the motor housing and drive wheel housing.

FIG. 10 is a perspective view of yet another exemplary configuration of projectile expelling apparatus 10, with the optional projectile dispensing mechanism 56 removed. With this configuration, rotational expelling housing 12 has not been tilted from horizontal, but the launch tube 14 has been rotated 180° from the rotational disposition used for a horizontal launch as depicted in FIG. 2 such that launch tube 14 now subtends motor housing 16 and drive wheel housing 18. The spin imparted to the projectile 90 will be delivered by pinching on the topside of the projectile 90 against the drive wheel 38. In this case, gravity affects the trajectory somewhat differently than with a horizontal launch. Generally, depending upon the speed at which the projectile 90 is expelled, this configuration may expel projectile 90 at a sinker or drop ball trajectory.

Figure 11:
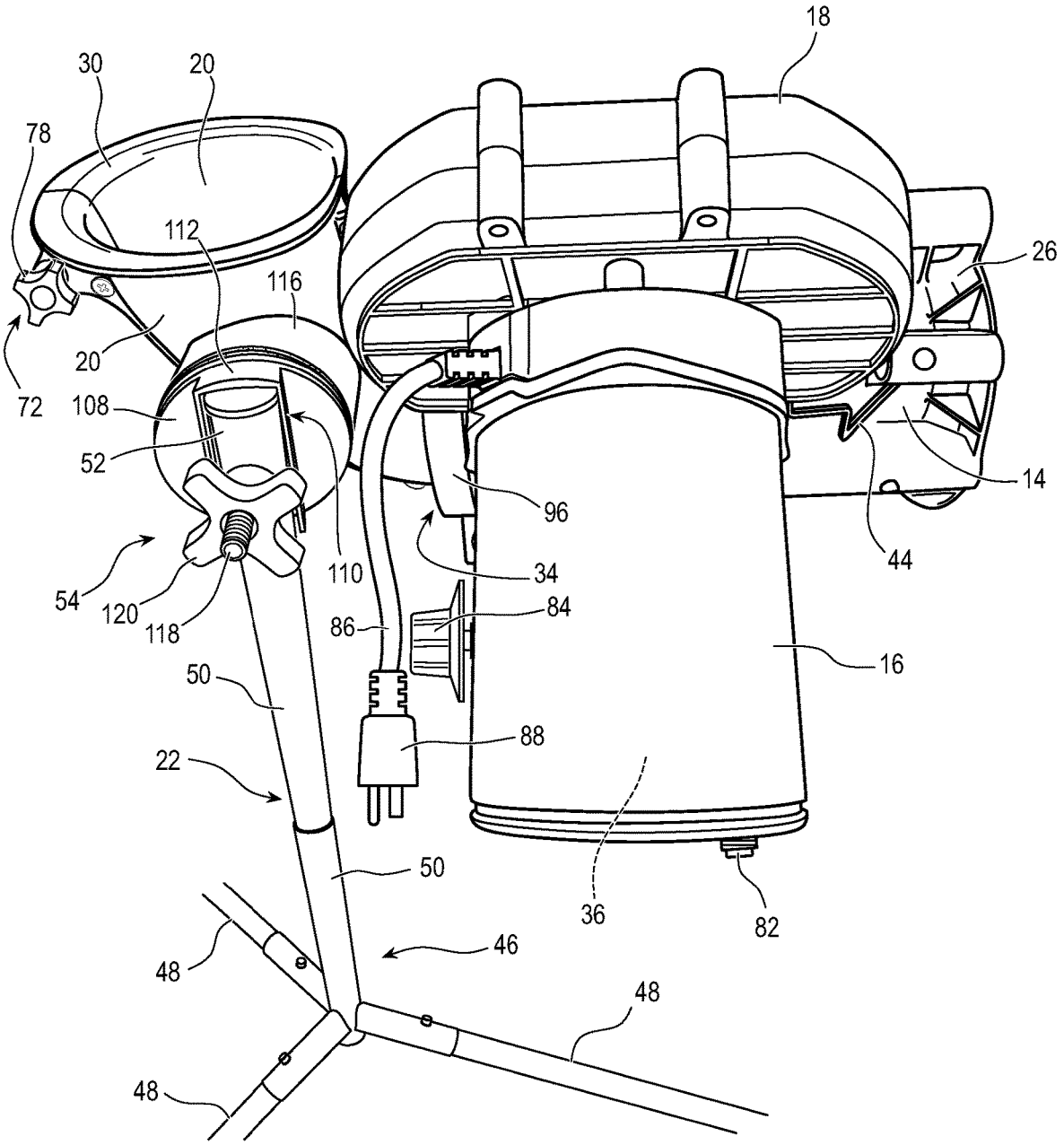
FIG. 11 is a perspective view of the exemplary projectile expelling apparatus with the pivot adjustment assembly securing the horizontal disposition of the launch tube and showing the rotational connection assembly rotated at an angle such that the launch tube angularly subtends the drive wheel housing.

FIG. 11 is a perspective view of still another exemplary configuration of projectile expelling apparatus 10, with the optional projectile dispensing mechanism 56 removed. With this configuration, rotational expelling housing 12 has not been tilted from horizontal, but the launch tube 14 has been rotated to a non-90° angle between 90° and 180° clockwise from the rotational disposition used for a horizontal launch as depicted in FIG. 2 such that launch tube 14, motor housing 16, and drive wheel housing 18 are angularly disposed from the horizontal configuration. The spin imparted to the projectile 90 will be delivered by pinching the projectile 90 against the drive wheel 38 at an angle. In this case, gravity affects the trajectory somewhat differently than with a horizontal launch. Generally, depending upon the speed at which the projectile 90 is expelled, this configuration may expel projectile 90 at a sinking, left-hand curve ball trajectory.

Figure 12:
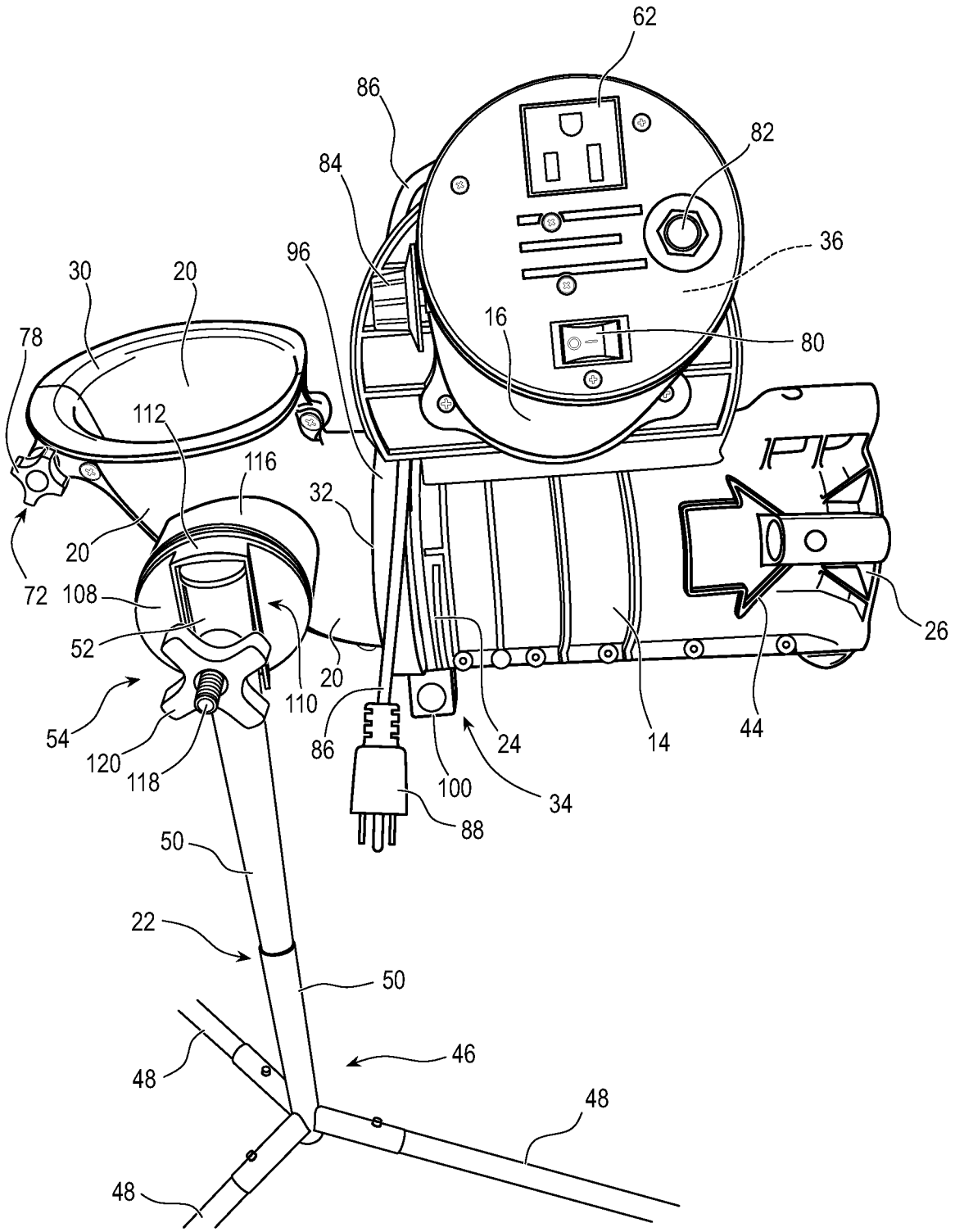
FIG. 12 is a perspective view of the exemplary projectile expelling apparatus with the pivot adjustment assembly securing the horizontal disposition of the launch tube and showing the rotational connection assembly rotated at another angle such that the launch tube angularly subtends the motor housing.

FIG. 12 is a perspective view of yet another exemplary configuration of projectile expelling apparatus 10, with the optional projectile dispensing mechanism 56 removed. With this configuration, rotational expelling housing 12 has not been tilted from horizontal, but the launch tube 14 has been rotated to a non-90° angle between 90° and 180° counterclockwise from the rotational disposition used for a horizontal launch as depicted in FIG. 2 such that launch tube 14, motor housing 16, and drive wheel housing 18 are angularly disposed from the horizontal configuration. The spin imparted to the projectile 90 will be delivered by pinching the projectile 90 against the drive wheel 38 at an angle different than the angle in FIG. 11. In this case, gravity affects the trajectory somewhat differently than with a horizontal launch. Generally, depending upon the speed at which the projectile 90 is expelled, this configuration may expel projectile 90 at a right-hand curve ball trajectory.

Of course, there are many other configurations and various speeds at which the projectile expelling apparatus 10 may operate, each of which may create a different trajectory for expelling projectiles 90. Consequently, the various embodiments and configurations of projectile expelling apparatus 10 make the invention disclosed herein extremely versatile, stable, and results repeatable.

Those skilled in the art will appreciate that the present embodiments are exemplary and should not be limited to the embodiments shown and described. Also, those skilled in the art will appreciate that the various configurations are exemplary and should not be limited to the configurations shown and described.

The present invention may be embodied in other specific forms without departing from its structures, methods, or other essential characteristics as broadly described herein and claimed hereinafter. The described embodiments and configurations are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. An enhanced projectile expelling apparatus, comprising:

a rotational expelling housing supported by a supporting stand, comprising:

a launch tube having a longitudinal axis, an ingress end, an exit end and a drive wheel opening;

a motor connected to a drive wheel, at least a portion of the drive wheel extending through the drive wheel opening, the motor for rotating the drive wheel;

a feeder elbow disposed to abut the ingress end of the launch tube, the feeder elbow comprising an entry end, an egress end, and a pivot axis, the pivot axis being transverse to the longitudinal axis of the launch tube;

a rotational connector assembly connecting the ingress end of the launch tube to the egress end of the feeder elbow in rotational abutting engagement, the rotational connector assembly having a secured mode wherein the rotational connector assembly prevents rotation of the launch tube in relation to the feeder elbow and a rotation mode wherein rotational connector assembly facilitates rotation of the launch tube in relation to the feeder elbow, rotational connector assembly is in the secured mode when tightened and is in the rotation mode when loosened; and a pivot adjustment assembly disposed at the pivot axis connecting the feeder elbow to supporting stand in rotational tilting engagement, pivot adjustment assembly comprising an anchoring transverse column connected to the feeder elbow and having a longitudinal axis coincident to the pivot axis, a pivot axis bolt that is anchored to the anchoring transverse column along the pivot axis, a receiving disk through which the pivot axis bolt passes, and a rotatable handle that receives the pivot axis bolt in tightening/loosening engagement, pivot adjustment assembly having a tiltable mode wherein the pivot adjustment assembly facilitates the tilting of the feeder elbow about the pivot axis and a non-tiltable mode preventing tilting of the feeder elbow about the pivot axis, pivot adjustment assembly is in the non-tiltable mode when tightened and is in the tiltable mode when loosened; and a projectile dispensing mechanism for delivering projectiles into the feeder elbow, the projectile dispensing mechanism comprising a core with a receiving cup, a helical ramp, and a retaining wall, the projectile dispensing mechanism further comprises a tilt-adjustable mounting hub, the tilt-adjustable mounting hub comprising a tiltable neck connected to a hub head and a tightening/loosening pivot pin about which the projectile dispensing mechanism pivots to position the projectile dispensing mechanism for delivering projectiles into the feeder elbow, the receiving cup for receiving the hub head in fitted engagement; and wherein rotating the launch tube while in the rotation mode is independent of tilting the feeder tube while in the tiltable mode.

2. The enhanced projectile expelling apparatus of claim 1 wherein the projectile expelling apparatus is in a base configuration when the longitudinal axis of the launch tube is disposed horizontal, and the drive wheel is aligned vertically below the longitudinal axis of the launch tube.

3. The enhanced projectile expelling apparatus of claim 2 wherein the projectile expelling apparatus is in a non-base configuration when at least one of the launch tube is rotated and the feeder elbow is tilted away from the base configuration.

4. The enhanced projectile expelling apparatus of claim 1 wherein the receiving disk further comprises an elongate recess for receiving at least a portion of the supporting stand in nesting engagement.

5. The enhanced projectile expelling apparatus of claim 1 wherein the motor is housed with a motor housing and the motor further comprises at least one of a speed control, an on/off switch, a power outlet, and a motor reset button.

6. The enhanced projectile expelling apparatus of claim 5 wherein the speed control regulates the speed at which the drive wheel rotates, the drive wheel imparting speed to the projectiles being expelled from the exit end of the launch tube.

7. The enhanced projectile expelling apparatus of claim 1 wherein the rotational connector assembly is a circular clamp.

8. The enhanced projectile expelling apparatus of claim 1 wherein the pivot adjustment assembly further comprises a first meshing teeth interface on the receiving disk and a second meshing teeth interface on the anchoring transverse column.

9. An enhanced projectile expelling apparatus, the projectile expelling apparatus for expelling projectiles at various trajectories and at various speeds, comprising:

a rotational expelling housing supported by a supporting stand, comprising:

a launch tube having a longitudinal axis, an ingress end, an exit end and a drive wheel opening;

a motor connected to a drive wheel, at least a portion of the drive wheel extending through the drive wheel opening, the motor for rotating the drive wheel, the motor having a speed control that regulates the speed of the drive wheel rotation;

a feeder elbow disposed to abut the ingress end of the launch tube, the feeder elbow comprising an entry end, an egress end, and a pivot axis, the pivot axis being transverse to the longitudinal axis of the launch tube;

a rotational connector assembly connecting the ingress end of the launch tube to the egress end of the feeder elbow in rotational abutting engagement, the rotational connector assembly having a secured mode wherein the rotational connector assembly prevents rotation of the launch tube in relation to the feeder elbow and a rotation mode wherein rotational connector assembly facilitates rotation of the launch tube in relation to the feeder elbow, rotational connector assembly is in the secured mode when tightened and is in the rotation mode when loosened;

a pivot adjustment assembly disposed at the pivot axis connecting the feeder elbow to supporting stand in rotational tilting engagement, pivot adjustment assembly comprising an anchoring transverse column connected to the feeder elbow and having a longitudinal axis coincident to the pivot axis, a pivot axis bolt that is anchored to the anchoring transverse column along the pivot axis, a receiving disk through which the pivot axis bolt passes, and a rotatable handle that receives the pivot axis bolt in tightening/loosening engagement, pivot adjustment assembly having a tiltable mode wherein the pivot wherein rotating the launch tube while in the rotation mode is independent of tilting the feeder tube while in the tiltable mode, and wherein the projectile expelling apparatus is in a base configuration when the longitudinal axis of the launch tube is disposed horizontal, and the drive wheel is aligned vertically below the longitudinal axis of the launch tube; and a projectile dispensing mechanism for delivering projectiles into the feeder elbow, the projectile dispensing mechanism comprising a core with a receiving cup, a helical ramp, and a retaining wall, the projectile dispensing mechanism further comprises a tilt-adjustable mounting hub, the tilt-adjustable mounting hub comprising a tiltable neck connected to a hub head and a tightening/loosening pivot pin about which the projectile dispensing mechanism pivots to position the projectile dispensing mechanism for delivering projectiles into the feeder elbow, the receiving cup for receiving the hub head in fitted engagement.

10. The enhanced projectile expelling apparatus of claim 9 wherein the projectile expelling apparatus is in a non-base configuration when at least one of the launch tube is rotated and the feeder elbow is tilted away from the base configuration, the projectile expelling apparatus being adjustable into one of multiple non-base configurations.

11. The enhanced projectile expelling apparatus of claim 10 wherein at least one non-base configuration of the projectile expelling apparatus expels the projectile on a curving trajectory.

12. The enhanced projectile expelling apparatus of claim 9 wherein the receiving disk further comprises an elongate recess for receiving at least a portion of the supporting stand in nesting engagement.

13. The enhanced projectile expelling apparatus of claim 9 wherein the rotational connector assembly is a circular clamp.

14. The enhanced projectile expelling apparatus of claim 9 wherein the pivot adjustment assembly further comprises a first meshing teeth interface on the receiving disk and a second meshing teeth interface on the anchoring transverse column.

15. A tilting and rotating projectile expelling apparatus supported for operation by a supporting stand, tilting and rotating projectile expelling apparatus comprising:

a feeder elbow comprising an entry end, an egress end, and a pivot axis;

a launch tube having a longitudinal axis, an ingress end, and an exit end, the ingress end of the launch tube disposed to abut the egress end of the feeder elbow, the feeder elbow pivot axis being transverse to the longitudinal axis of the launch tube;

a rotational connector assembly connecting the egress end of the feeder elbow to the ingress end of the launch tube in rotational abutting engagement, the rotational connector assembly having a secured mode wherein the rotational connector assembly prevents rotation of the launch tube in relation to the feeder elbow and a rotation mode wherein rotational connector assembly facilitates rotation of the launch tube in relation to the feeder elbow, the rotational connector assembly is in the secured mode when tightened and is in the rotation mode when loosened;

a pivot adjustment assembly disposed at the pivot axis connecting the feeder elbow to the supporting stand in rotational tilting engagement, the pivot adjustment assembly comprising an anchoring transverse column connected to the feeder elbow and having a longitudinal axis coincident to the pivot axis, the pivot adjustment assembly having a tiltable mode wherein the pivot adjustment assembly facilitates the tilting of the feeder elbow about the pivot axis and a non-tiltable mode preventing tilting of the feeder elbow about the pivot axis, pivot adjustment assembly is in the non-tiltable mode when secured and is in the tiltable mode when unsecured;

a projectile dispensing mechanism for delivering projectiles into the feeder elbow, the projectile dispensing mechanism comprising a core with a receiving cup, a helical ramp, and a retaining wall, the projectile dispensing mechanism further comprises a tilt-adjustable mounting hub, the tilt-adjustable mounting hub comprising a tiltable neck connected to a hub head and a tightening/loosening pivot pin about which the projectile dispensing mechanism pivots to position the projectile dispensing mechanism for delivering projectiles into the feeder elbow, the receiving cup for receiving the hub head in filled engagement; and wherein rotating the launch tube while in the rotation mode is independent of tilting the feeder tube while in the tiltable mode.

16. The tilting and rotating projectile expelling apparatus of claim 15 further comprising a spin imparting structure for influencing a projectile being expelled to spin predictably when the projectile engages the spin imparting structure.

* * * * *